United States Patent [19]

Dixon

[11] Patent Number: 4,806,392

[45] Date of Patent: Feb. 21, 1989

[54] LIQUID LIGHT TREE

[76] Inventor: Kenneth Dixon, 1462 Petty Rd., Graham, N.C. 27253

[21] Appl. No.: 165,081

[22] Filed: Mar. 7, 1988

[51] Int. Cl.[4] ..... A47G 33/06

[52] U.S. Cl. ..... 428/18; 362/96; 362/123

[58] Field of Search ..... 362/123, 96; 428/18, 428/19, 20; 40/406

[56] References Cited

U.S. PATENT DOCUMENTS

| | | | |
|---|---|---|---|
| D. 236,216 | 8/1975 | Fred | 428/18 X |
| 3,174,688 | 3/1965 | Chatten | 362/96 X |
| 3,677,867 | 7/1972 | Westlund | 362/123 X |
| 3,744,166 | 7/1973 | Rielle | 40/406 |
| 3,930,334 | 1/1976 | Johnson | 40/406 X |
| 3,995,151 | 11/1976 | Nordeen et al. | 362/96 |
| 4,352,149 | 9/1982 | Stetler | 362/806 X |
| 4,612,219 | 9/1986 | Tengs | 428/18 X |

*Primary Examiner*—Henry F. Epstein

[57] ABSTRACT

The liquid light tree is a completely new method of constructing and enhancing the beauty in central symbol of the Christmas season. The tree consists of a skeleton of colorful, wavy, treelike strands (36) of material which are curved to match the outline of a traditional Christmas tree. These strands (36) are pivoted around a center pole (30) to form the image of a hollow, transparent tree. The effect of blinking lights is produced by pumping a liquid down the skeleton of wavy strands (36). The quick beads of fluid dart in and out creating a sparkling visual effect. The flowing fluid is given additional effect in a dark setting much like a traditional tree. The tree has lights at the top and bottom of the tree which enhances the fluid flow. The beads of fluid reflect the light and give the impression that each bead is a light in itself moving quickly down the tree replaced again and again by other beads of liquid light.

12 Claims, 3 Drawing Sheets

LIQUID LIGHT TREE

BACKGROUND—FIELD OF INVENTION

This invention relates to Christmas decorations, especially to an artificial table top Christmas tree which utilizes a new type of construction with a new and modern visual effect.

BACKGROUND—DESCRIPTION OF PRIOR ART

Heretofore, Christmas trees and more specifically artificial table top trees have mostly been constructed to appear as live, traditional trees. Trees with artificial, lifelike, evergreen branches that would extend from a center trunk in a treelike manner. These trees are very good in the traditional sense of creating a Christmas tree from a live tree. Yet such a tree could be viewed as old and outlived in a ever changing and improving society such as ours. More untraditional types of tree constructions consist of trees made from brightly reflective tinsel and other reflective materials. Most of these reflective materials were used to form the branches for the trees. Still other trees presented these reflective materials in more unique arrangements such as spirals and revolving wings. While these trees hold many pleasant visual qualities, the uniqueness of these designs may have well lost some of their appeal through the years.

The construction method closest resembling the method explained in this patent application would be "Ornamental Device Using Liquid Droplets" in U.S. Pat. No. 3,174,688 to Chatten. Chatten's ornamental devices use slow moving fluid flowing on straight colorless lines to create an intangible ornament. Yet my tree is quite different from this as my next section will explain.

OBJECTS AND ADVANTAGES

Accordingly, I claim the following as my objects and advantages of the invention: To provide a new design for a very old symbol of the Christmas season. A design which gives the public a modern and uniquely decorative tree which resembles a traditional tree only by the outline of its treelike skeleton. A hollow and transparent skeleton which is formed from a complete revolution of a plurality of its colorful, rigid strands. Strands which bend in and out on a flat plane in order to duplicate the outline of a traditional tree.

In addition, I claim an artificial Christmas tree which replaces traditional blinking lights with rapidly flowing fluids which dart in and out along the tree's skeleton of strands. Fluids that get their color from the brightly colored strand they're traveling on. Beads of fluid that give the visual effect of small moving colored lights when bathed with lights enhoused in the tree.

In addition I claim the following objects and advantages: A design which goes beyond the visual effect created by Chatten's U.S. Pat. No. 3,174,688. A patent of ornamental devices which create a visual effect of slow moving fluids flowing down straight lines of an intangible figuration. Furtherly, I claim an invention which forms a tangible and perceptable object with fast flowing fluids. Fluids which quickly change directions in and out making them shimmer with color and motion.

Readers will find further objects and advantages of the invention from a consideration of the ensuing description and the accompanying drawings.

DRAWING REFERENCE NUMERALS

Figure 1:
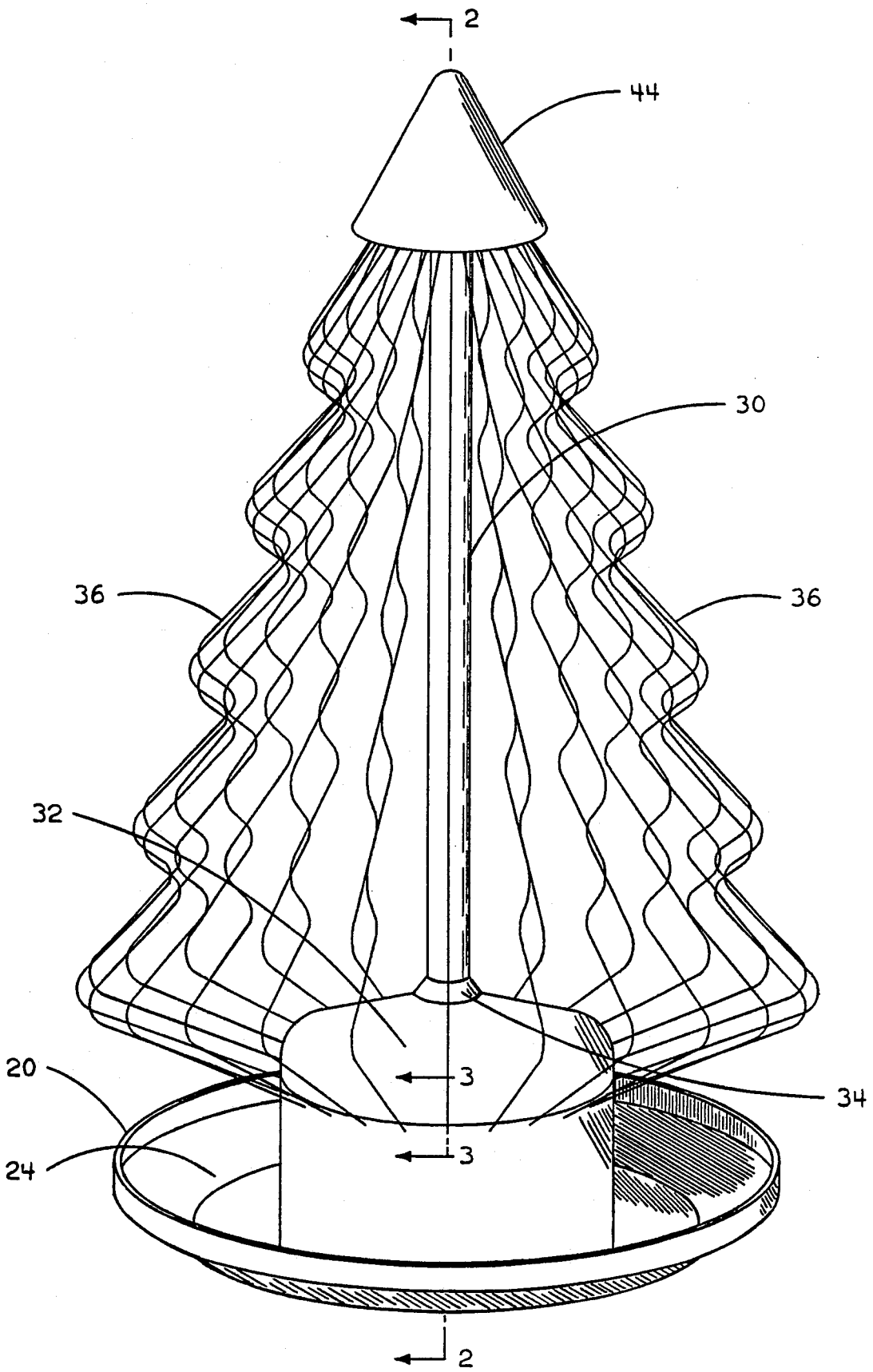
FIG. 1 shows a full perspective elevational view of the preferred embodiment of the liquid light tree.

20 base
22 center pole flange of 20
24 reservoir of 20
26 reservoir nipple of 20
28 strand slots of 20
30 center pole
32 light cap
34 fluid seal
36 strands
38 fluid dispenser
40 strand sheaths of 38
42 dispenser nipple of 38
44 cone

DESCRIPTION OF INVENTION

Figure 2:
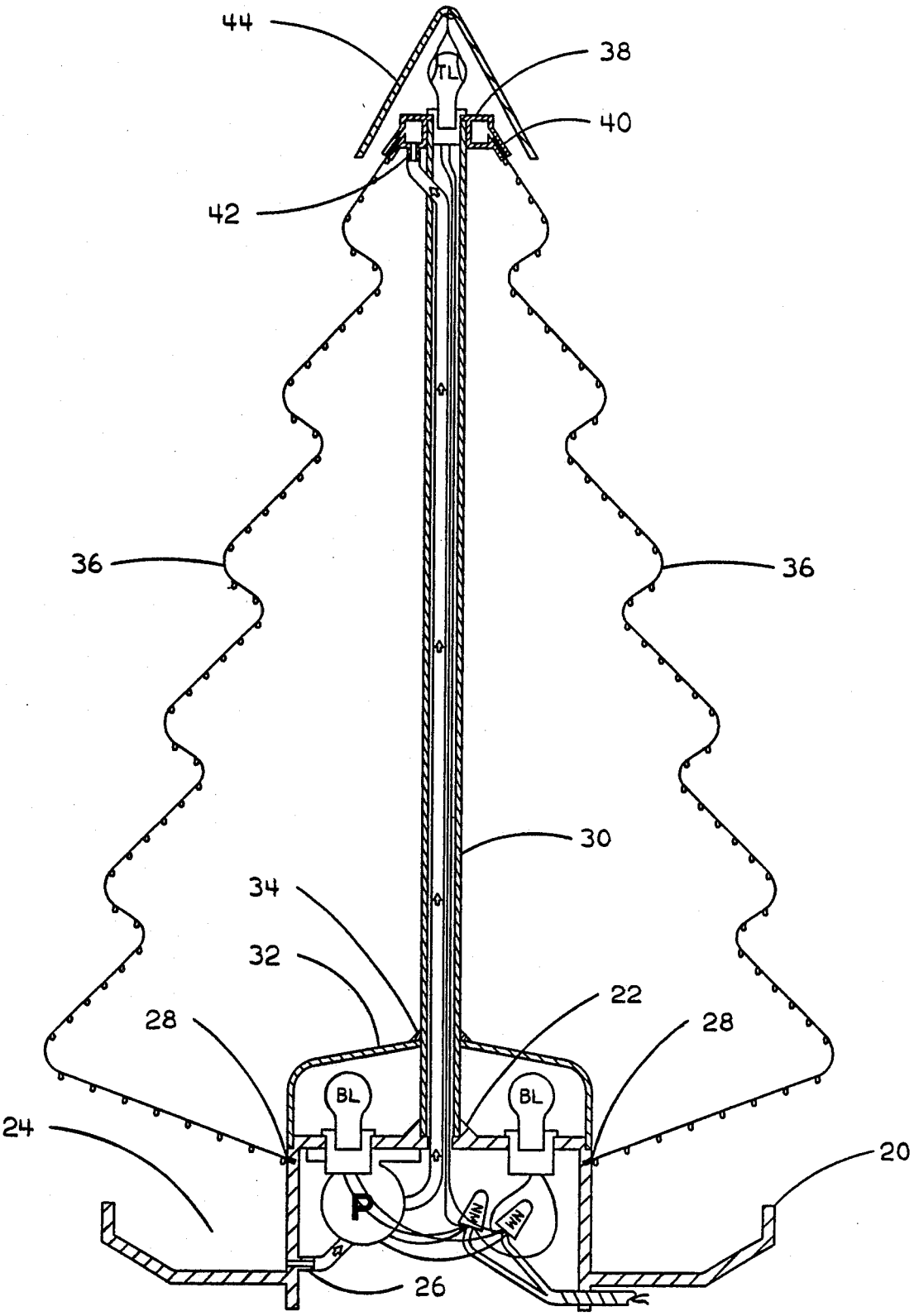
FIG. 2 shows a full elevational section view of the said tree taken along the line 2—2 of FIG. 1.

FIG. 2 shows the liquid light tree according to the preferred embodiment of the invention. The invention comprises a base 20 which is preferrably molded in one piece from plastic. The base 20 is shaped like a round shallow pan with an upside down bowl in the middle. The base 20 has a built in flange 22 on its top which accepts the center pole 30. The base 20 also has slots 28 that are used to accept the trees stands 36. These slots 28 are equally spaced around the perimeter of the base. Center pole 30 is a hollow plastic tube which attaches to the base's center pole flange 22. The light cap 32 is a thin plastic piece resembling an upside down shallow dish. The light cap 32 fits on top of the base 20. There is a round hole in the top of the light cap which allows the center pole 30 to penetrate it and attach to the base 20. The fluid seal 34 is a small plastic ring that fits tightly around the center pole 30 and is positioned just above the light cap 32.

Figure 4:
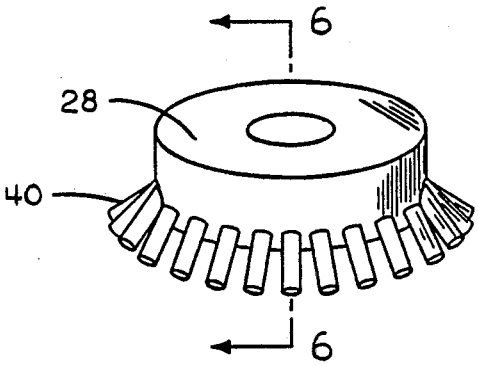
FIG. 4 shows a perspective of the preferred fluid dispenser.
Figure 5:
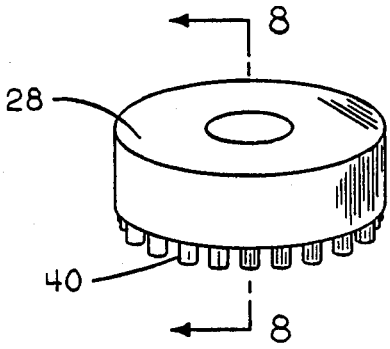
FIG. 5 shows a perspective of one other type of fluid dispenser.
Figure 6:
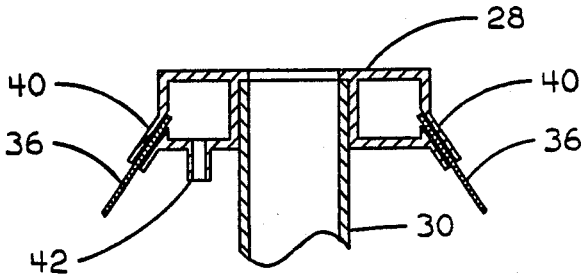
FIG. 6 shows a sectional view of the preferred fluid dispenser taken along the line 6—6 of FIG. 4.
Figure 8:
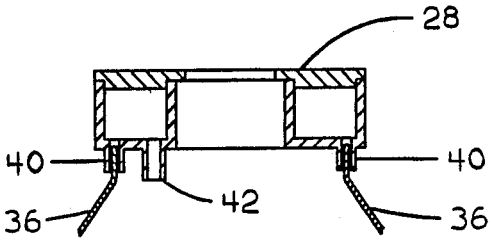
FIG. 8 shows a section of the other fluid dispenser taken along the line 8—8 of FIG. 5.

The fluid dispenser 38 is a hollow, doughnut shaped plastic part which fits around the center pole 30 at its top. FIGS. 4 and 6 best show the fluid dispenser 38 in its preferred embodiment. The fluid dispenser 38 has 24 or more evenly spaced hollow sheaths 40 extending from its perimeter at a downward angle which accepts the tree's strands 36. The fluid dispenser 38 also has one dispenser nipple 42. FIGS. 5 and 8 show the fluid dispenser 38 in another embodiment. This embodiment shows the sheaths 40 protruding from the bottom perimeter of the fluid dispenser 38.

The strands 36 as seen in FIG. 2 are wavy, colored, rigid strands which bend in and out on a flat plane. The bends in the strands 36 are designed to duplicate the curves in an outline of a traditional Christmas tree. The strand's shape is rigid and requires no outside force to hold its curves in place. The strands 36 are preferrably made from colorful plastic coated wire. The invention requires 24 or more strands 36 which form skeleton-like structure which is the tree. The strands 36 attach to the fluid dispenser 38 at the top and the strand slots 28 at the bottom.

The cone 44 is a plastic cone shaped piece. The preferred embodiment of the cone 44 is best seen in FIG. 2. FIG. 2 shows the cone 44 with a bulb wire in its inside top that attaches it in its intended position on top of the tree.

Operation of Invention

The liquid light tree of FIG. 1 is an artificial Christmas tree which uses fast moving fluids flowing down its skeleton of strands 36 to produce an exciting new shimmering effect.

Figure 3:
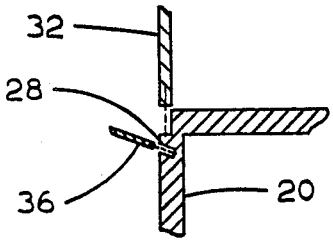
FIG. 3 shows an enlarged sectional detail taken along the line 3—3 of FIG. 1.

The liquid light tree's base 20 can be best seen in FIG. 2. The tree's base 20 supports the tree and center pole 30. It also is designed to provide a reservoir 24 for the fluid while enhousing the pump, lights, wiring, etc. and separating the two from contact. The base 20 is also designed to catch any fluid drippings from the tree when it is first started up. FIG. 3 best shows how the base's strand slots 28 accepts the strands 36 and how the light cap 32 fits on the base 20. The strands 36 are locked into position in their allotted slots 28 preferrably by a close fit and adhesive. The light cap 32 is locked on the base with an adhesive, providing a leak proof seal. This is the preferred embodiment for the base 20 but many alternate forms may be used as long as they provide a fluid reservoir, enhouse the pump, lights, wiring, etc. and support the trees center pole 30 and anchor the tree's strands 36. Such an alternate method would especially be beneficial when the tree is built in an upscaled size.

The center pole 30 as seen in FIG. 2 serves as the spine of the tree. It is hollow so its center can serve as a passageway for pumping the fluid up totthe fluid dispenser 38 and the electrical wiring for the top light. The top light is designated in FIG. 2 by a TL inside a bulb shaped component. The center pole's 30 open top serves as a cup for holding the top light. Many alternate methods of attaching the top light in its position under the cone exist.

The light cap 32 as seen in FIG. 2 serves as a filter for coloring the bottom lights. The bottom lights are designated by a BL inside a bulb shaped component. The light cap 32 also serves to prevent liquid from entering inside the base 20. The 1:ght cap's top is slanted outwardly from the center pole 30 in order to direct fluid toward the bases's reservoir 24. FIG. 3 best shows one possible method of providing a sealed fit to the base 20. An adhesive would be used to lock the light cap in place. Many alternate methods for such a leak proof joint could be employed. The bottom lights and light cap provide the built in light needed to bathe the fluid drops and cause the shimmering effect especially when viewed in a dark setting.

The fluid seal 34 as seen in FIG. 2 is used to seal the hole in the light cap 32 around the center pole 30 and thus preventing any leakage of fluid into the light cap 32. The fluid seal 34 is attached and sealed in place with an adhesive.

Figure 7:
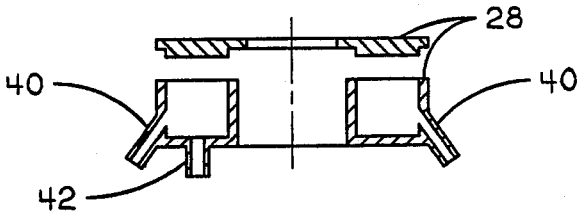
FIG. 7 shows a section of the preferred fluid dispenser similar to FIG. 6 relating to a two piece construction.

The fluid dispenser 38 as seen in FIG. 2 is used to feed the fluid to each strand 36 in equal amounts while providing positioning for them at the top. The fluid dispenser 38 receives the fluid from the pump's output hose which exits the center pole 30 beneath it and inserts on the dispenser nipple 42. The fluid dispenser 38 as seen in FIGS. 4 and 6 has 24 or more evenly spaced hollow sheaths extending from its sides at a downward angle which accept the strands 36 in order to position and supply them with fluid. The fluid dispenser's enclosed design allows the physical laws of fluid pressure to push equal amounts of fluid out the sheaths 40 to each strand 36. The fluid dispenser's 38 doughnut shape allows it to separate the fluid from the center pole 30 and thus any electrical dangers associated with contact to electrical wiring. The fluid dispenser 38 explained above is the preferred method for its construction but many alternate methods exist. FIGS. 5, 7, and 8 show some of these methods. FIG. 7 shows the fluid dispenser 38 constructed in two parts. The top must be attached to the main body with an adhesive. FIGS. 5 and 8 shows the fluid dispenser 38 with its sheaths 40 protruding from its outside bottom. This method's advantage may be in its easier production cost. This method would need a slightly different bend in the strands 36 as shown. FIG. 8 shows both the two part construction and the bottom sheaths.

The strands 36 as seen in FIG. 1 aze probabIy the most important element of the tree. They give the tree its recognition as an artificial Christmas tree while providing the path for the fluid and thus it twinkling visual effect. The strands 36 form the skeleton-like structure of the tree by an evenly spaced positioning around the center pole 30. The strands 36 come in a wide variety of colors to add beauty in many combinations of color. It is this color on the strand which gives the tree and its fluid their color. The fluid, preferrably cooking oil, adds increased lustre and shine to the tree's colors whether its action is on or not. The fluid's flow on the strand 36 is seen in FIG. 2. The beads of fluid are constantly switching from one side of the strand to the other as gravity directs it to the underside of the strand 36. This action with the fluid's constant change of direction adds dramatically to the overall visual effect of the tree. The unique shape of the strands 36 are what allows for the new visual effect of the liquid light tree. FIG. 2 shows how the strands 36 fit into the fluid dispenser 38 at the top and the strand slots 28 at the bottom. The strands 36 are locked into position in the slots 28 with a force fit and adhesive. Many different methods of securing the strands 36 to the base 20 are possible. Manufacturing ease and cost may well decide the best method. The preferred material for the strands 36 is 16 gauge galvanized wire which has a plastic coating. This material can be bent to the desired shape and provides excellent color, shine and fluid flow characteristics. The strands 36 can be built of other materials also as long as they possess the shape, color and fluid flow qualities mentioned above. A molded plastic strand 36 may prove to be the best strand material because of its ease of manufacture. Larger tree sizes may require a bigger or stronger material.

The strands 36 as seen in FIG. 2 can vary in respect to their construction. The construction of a strand 36 consists of the radius of the curves and the construction ang1es from a inside curve down to the next outside curve. The preferred method for the table top unit described in this paper is a 0.375" outside radius to a 0.25" inside radius. The center point of these radiuses would be on center vertically and 0.75" apart. The angle between a inside curve down to the next outside curve is 45 degrees. The first angle at the top is slightly steeper at 55 degrees. This melts into the cone angle of 60 degrees. The last angle at the bottom is optional as are all these measurements but my preferred angle is 20 to 30 degrees. The outside curves of the tree are positioned tangent to a line drawn at 70 degrees tangent from the top curve. This strand data is given as a guide line for one preferred manner of constructing the strands 36 but many other variations exist.

The cone 44 as seen in FIG. 2 is used as a filter for the top light, designated by the letters TL, and is used to hide the fluid dispenser 38 and give the tree's top a neat, finished appearance. The preferred color for the top is red but it could come in many colors. The cone is shown to contain a bulb wire positioned in its inside center which holds the cone in place on the top light. The cone 44 could also be designed with many types of art work attached to it. Examples of such could include the traditional types such as stars and angels but could also be more untraditional such as stuffed birds or animals.

The liquid light tree's action can be best traced as seen in FIG. 2. The electricity goes into the inner base where it is split off in four directions with the aid of wire nuts. The wire nuts are designated on the drawing by the letters WN. The electricity goes to the top light through wires traveling the center pole 30. Electricity is also fed to both of the bottom lights in the base so it can light all of the bulbs up and bathe the tree with colored light from the top and bottom. The last bit of electricity is fed to the small pump which is fixed to the inside top of the base. The pump is designated by a circle with a P in it. The pump's inlet hose is attached to the reservoir nipple 26 where it draws fluid from the reservoir 24. The outlet hose runs up the center pole 30 where it exits the center pole 30 and attaches to the fluid dispenser nipple 38. The outlet hose is sealed where it exits the center pole 30 in order to prevent any fluid from entering the center pole 30. The pump's start causes the fluid to fill the fluid dispenser 38 where it distributes evenly to all of the strands 36. This starts the exciting new visual appeal of seeing the fluid flow quickly down the tree's strands causing the tree's skeleton-like structure to sparkle with movement and color. The preferred fluid for operation in the liquid light tree is cooking oil. This fluid provides excellent speed without giving up good adhesion to the strands 36.

The pump can be an alternating current or direct current pump. A DC pump will need the addition of an AC to DC transformer which can step down the electricity needed to run the pump. DC lights could also be employed for running the tree entirely with DC electricity. This may prove to be advisable because of possible electrical dangers even though the tree is designed to prevent contact of the fluid with any electrical apparatus.

One possible ramification for constructing the invention described here would be to include a solid body around the center pole 30 which would obscure the hollow, transparent quality ot the tree. The core could be cone-like in order to mirror the spread of the tree from top to bottom. This cone could be made of many materials. A material that would preferrably reflect the sparkling action of the fluid flow. A material that would shed the fluid and possibly extend the light cap 32 or include other light sources.

Another ramification could be to add more strands 36 either on the same level or smaller ones inside the main outside skeleton of strands.

The liquid light tree is a completely new type of artificial Christmas tree or the like. A tree that gets its hollow, transparent shape from a skeleton-like structure of colorful, wavy and rigid strands that are pivoted around a center pole. A tree that comes alive with hundreds of quickly darting simulated colored lights that don't just decorate the tree but are the tree.

The liquid light tree would almost sell itself when one sees its brillant display of shimmering, colorful motion. High sales potential is readily possible both by this raw beauty and by the selling season it is associated with. A season where consumers spend more money for gifts and products than any other time of the year. Thus it is easy to see the potential for sales that this product has. With such a big money making potential from the public acceptance I anticipate my invention would have. I feel it has enormous need for patent protection in order to try to prevent others from unfairly reaping its financial rewards.

While my above description contains many specifications, these should not be construed as limitations on the scope of the invention, but rather as an exemplification of one preferred embodiment there of. Many other variations are possible. For example a wide variety of specific materials could be used to form the strands with. Many different typed of fluids could be employed with the same desired effects. The tree's center pole could be transparent and its hollow could be used to pump the fluid to the top by filling the entire tube and possitly giving a nice visual effect. Many different combinations of color in the tree's components and lights could be used. The enhoused lights could blink, spin or change colors to add to the visual effect. Scents such as pine or peppermint could also be added to the fluid in order to give appeal to the sense of smell. Accordingly, the scope of the invention should be determined not by the embodiment illustrated, but by the appended claims and their legal equivalents.

I claim:

1. An artificial Christmas tree comprising:

a. a plurality of colorful rigid strands which bend in and out in order to duplicate the outline of a traditional Christmas tree, b. a skeleton-like structure of said strands which are pivoted around a center to form said tree, c. a structural means for supporting said tree, d. a distribution means for feeding a flow of viscous fluid at the top of each said strand in order to flow quickly down the said strands of the said tree, e. a collection means for holding said fluid in a reservoir at the bottom of said tree, f. a recycling means for pumping said fluid from said reservoir to the said distribution means at the top of said strands.

2. The artificial Christmas tree of claim 1 wherein said means for supporting said tree is a dish styled base with a hollow center pole serving as a spine for said tree.

3. The artificial Christmas tree of claim 1 wherein said distribution means is a round hollow part with hollow sheaths extending around its perimeter located at the top of said center with said strands inserted in said sheaths.

4. The artificial Christmas tree of claim 1 wherein said reservoir for said fluid is the dish shaped quality incorporated into the design of the said structural means for the said tree.

5. The artificial Christmas tree of claim 1 wherein said recycling means is a small pump drawing said fluid from said reservoir and pumping said fluid to said distribution means.

6. The artificial Christmas tree of claim 1 wherein said strands are made of plastic coated wire.

7. The artificial Christmas tree of claim 1 wherein said strands are made of molded, rigid plastic.

8. The artificial Christmas tree of claim 1 wherein the said viscous fluid is cooking oil.

9. The artificial Christmas tree of claim 1 wherein enhoused lights are employed to enhance the tree's fluid flow action.

10. The artificial Christmas tree of claim 1 wherein said tree is built in any size.

11. The artificial Christmas tree of claim 1 wherein said fluid is colored.

12. The artificial Christmas tree of claim 1 wherein a cone-like part is employed to cover said distribution means and give a neat appearance to the top of said tree.

* * * * *